United States Patent [19]

Schurr

[11] 4,295,583

[45] Oct. 20, 1981

[54] CLOSURE CAP VENT

[75] Inventor: Robert E. Schurr, Garrett, Ind.

[73] Assignee: Rieke Corporation, Auburn, Ind.

[21] Appl. No.: 65,183

[22] Filed: Aug. 9, 1979

[51] Int. Cl.[3] ..... F65D 25/44

[52] U.S. Cl. ..... 222/478; 222/488; 222/530; 222/566

[58] Field of Search ..... 222/478, 530, 488, 527, 222/569, 566, 529, 567

[56] References Cited

U.S. PATENT DOCUMENTS

| | | | |
|---|---|---|---|
| 2,281,447 | 4/1942 | Maloney | 222/478 X |
| 2,561,596 | 7/1951 | Rieke . | |
| 2,565,699 | 8/1951 | Rieke . | |
| 2,661,128 | 12/1953 | Rieke . | |
| 2,895,654 | 7/1959 | Rieke . | |
| 2,981,448 | 4/1961 | Anderson | 222/569 X |
| 3,040,938 | 6/1962 | Smith | 222/478 |
| 3,604,740 | 9/1971 | Summers . | |
| 3,613,966 | 10/1971 | Summers . | |
| 3,717,289 | 2/1973 | Laurizio | 222/529 X |
| 3,804,305 | 4/1974 | Rieke . | |

FOREIGN PATENT DOCUMENTS

| | | | |
|---|---|---|---|
| 648664 | 8/1837 | Fed. Rep. of Germany | 222/478 |
| 1513468 | 1/1968 | France | 222/569 |
| 1318715 | 5/1973 | United Kingdom .. | |

*Primary Examiner*—Robert J. Spar
*Assistant Examiner*—Frederick R. Handren
*Attorney, Agent, or Firm*—Woodard, Weikart, Emhardt & Naughton

[57] ABSTRACT

A venting device for use with a container closure cap of the type having a flexible pouring spout which is extendable to a pouring orientation from a nested orientation includes a hollow central body portion having a top end, a base and an interior passageway extending therethrough. Joined to the top end of the central body portion is a generally cylindrical portion and joined to the top of this generally cylindrical portion is a frustoconical portion. The base of the central body portion is integrally joined to a substantially flat flange portion which includes a spaced plurality of outwardly radiating ribs. The venting device is joined to the flexible pouring spout of the container closure cap by means of spacer strips which are heat welded between the venting device and the closure cap thereby positioning the venting device in a concentric relationship to the closure cap. These spacer strips provide a series of air flow passageways for the entry of venting air so that such air does not enter the pouring orifice which would result in pulsations to the exiting liquid flow. The outwardly radiating ribs are pulled into abutting engagement with the edge of the flexible pouring spout when the spout is extended to a pouring orientation and these ribs provide only a very slight clearance for the venting air to enter the conatiner so that the clearance provided is sufficiently small to prevent the exit of viscous fluids through the clearance areas.

8 Claims, 5 Drawing Figures

CLOSURE CAP VENT

BACKGROUND OF THE INVENTION

This invention relates in general to container closure devices and in particular to such devices which employ venting means as part of the pouring spout in order to allow air to enter the container without creating disruptions and pulsations in the exiting fluid flow.

The evolution of present-day container closure devices of a type similar to that disclosed by the present invention can be traced from as early as the mid 1940's by a review of the developments and improvements which are disclosed in the following chronologically arranged list of patents.

| Patent No. | Patentee | Issue Date |
|---|---|---|
| 2,561,596 | Rieke | 7/24/51 |
| 2,565,699 | Rieke | 8/28/51 |
| 2,661,128 | Rieke | 12/01/53 |
| 2,895,654 | Rieke | 7/21/59 |
| 3,040,938 | Smith | 6/26/62 |
| 3,604,740 | Summers | 9/14/71 |
| 3,613,966 | Summers | 10/19/71 |
| 3,804,305 | Rieke | 4/16/74 |

Rieke ('596) discloses a pouring spout which is nestable within a container and is extendable to a pouring orientation and contractable to a nested orientation. The spout is initially disposed in a closed arrangement by an integral portion which must be cut or slit in order to allow the contents to be poured from the container. The outer periphery of the pouring spout is secured to the container opening by means of a clamping ring of light metal which is readily deformed by a hand-operable crimping tool.

Rieke ('699) discloses a flexible, retractable dispensing spout normally nestable within a container and mounted in an opening therein. A junction portion signifies the point of union between the outer cap member, which forms the base of the extended spout, and the inner spout portion. The spout is sealed by a closure portion comprising a seal which is located immediately contiguous to the junction portion. The seal includes an integral pull member which extends upwardly from the seal and is located quite close to the inside surface of the spout portion. Removal of the seal is accomplished by the use of a tool, such as pliers, which have a suitable narrow-nose design in order to be able to grip the pull member without interfering with the inside surface of the spout portion.

Rieke ('128) is a continuation-in-part patent of patents Rieke ('596) and Rieke ('699) and further discloses a tamper- and seal-proof flexible pouring spout. A tamper-indicating seal is disposed over the end of the spout and may include a semi-severed, tear-out portion which must first be removed in order for the tamper-seal indicator to be removed. Alternatively, this tamper-indicating seal may be removed by a prying action. Disposed within the spout opening at the uppermost end is an integral plug which is joined to the inside periphery of the spout by means of an annular weakened junction which must be severed with a knife in order to open the spout.

Rieke ('654) discloses a bail handled closure cap of a character to be internally threaded for screw threading into closing position upon an externally threaded member, such as a container neck, spout or the like. The bail is connected with the cap through opposed and substantially diametrically extending bosses by means of suitable hinged arrangements.

Smith discloses a vented pour spout wherein a venting unit is rigidly secured to the inside surface of a flexible pour spout, of the type disclosed by the prior listed patents. This venting unit permits the entry of air into the container so as to enable a smooth, continuous flow of fluid from the container by way of the pour spout.

Summers ('740) discloses a container closure combination which is anchored into a container opening by means of a boss and circular anchor ring. The container is plastic and the boss includes an upwardly protruding lip which is sandwiched within an inverted U-shaped annular portion of the closure. The anchoring ring is disposed about the annular portion and when crimped together holds the members together. This arrangement precludes any separation or leakage at the closure, thereby overcoming typical cold flow characteristics of those plastics which are usually employed in such arrangements.

Summers ('966) discloses a nestable pouring spout with a wall-supporting cap of the style that includes an elongated skirt portion. This elongated skirt portion extends coaxially with the neck and body portions of the spout to a point near the intersection of these two portions. The space between the neck portion and body portion at this intersection location is large enough to permit easy removal of the cap and is small enough to permit the skirt portion to support the body portion and avoid stress cracking due to unrestrained movement of the body portion in response to internal container pressure.

Rieke ('305) discloses a container closure concept which includes a flanged overseal closure member having a central cap portion, an intermediate portion and a rim portion.

Although each component part of the overall closure cap assembly potentially represents an area for possible design improvement, the subject invention involves only the design and assembly of a venting unit for use with the type of container closure concept disclosed by these various prior art references and related closure structures. The vent design of the subject invention is an improvement over the Smith patent vent design in that fluid friction losses are accommodated by the rate of taper of the sides of the vent unit in order to assure a positive fluid pressure and prevent venting air from entering the pouring orifice. Further, the subject invention is an improvement for use with container contents which are extremely viscous in that the air entry ports are maintained with a very small clearance size which precludes the flow of viscous fluid into the air passageways.

SUMMARY OF THE INVENTION

A venting device for use with a container pour spout to allow the entry of air at a location exterior to the exiting fluid flow stream according to one embodiment of the present invention comprises a hollow central body portion having a top end, a base and an interior passageway extending therethrough, a generally cylindrical portion joined to the top end, a frustoconical portion joined to the cylindrical portion and tapering inwardly and upwardly, and a substantially flat flange portion integral with the base and including a spaced plurality of outwardly radiating ribs.

One object of the present invention is to provide an improved venting device for use with container closure caps.

Related objects and advantages of the present invention will be apparent from the following description.

DESCRIPTION OF THE PREFERRED EMBODIMENT

Figure 1:
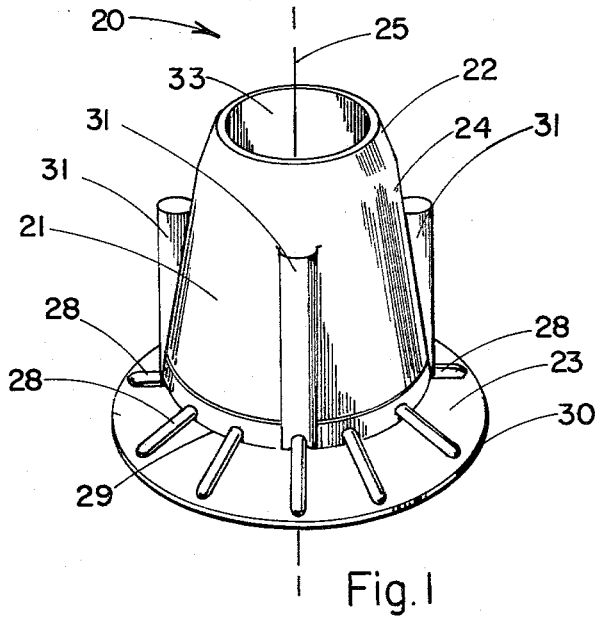
FIG. 1 is a perspective view of a venting device according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
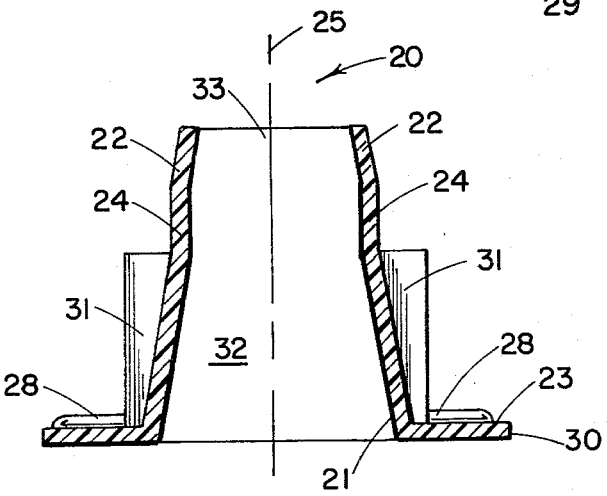
FIG. 2 is a front elevation view in full section of the FIG. 1 venting device.

Referring to FIGS. 1 and 2, there is illustrated venting device 20 which includes hollow central body portion 21, frustoconical portion 22 and substantially flat flange portion 23. Although central body portion 21 and frustoconical portion 22 both taper inwardly and upwardly at approximately the same rate or angle, they are offset from each other by means of cylindrical portion 24 which is disposed between and joined to the top edge of body portion 21 and the bottom edge of frustoconical portion 22. In fact, portions 21, 22, 23 and 24 are all integrally joined with each other and the preferred method is by molding with any one of a variety of synthetic compounds. Portions 21, 22 and 24 have a substantially circular cross-sectional shape taken in a direction perpendicular with the longitudinal axis of the venting device. The longitudinal axis is represented by line 25.

Substantially flat flange portion 23 includes on its upper surface a series of 12 evenly spaced outwardly radiating ribs 28. Each rib 28 extends from the base 29 of central body portion 21 to the outer edge 30 of flange portion 23. Each rib is slightly radiused across its uppermost surface and is approximately the same thickness at its maximum point as the thickness of flange portion 23 between the ribs. Integral with the outside surface of central body portion 21 are a series of four stiffener portions 31 which are equally spaced and extend from the top surface of flange portion 23 to the top end of body portion 21 (to the point at which cylindrical portion 24 begins). The four stiffener portions 31 are oriented around the circumference of central body portion 21 such that they are placed in alignment with four of the outwardly radiating ribs 28. This alignment of portions 31 and ribs 28 creates the appearance of a continuous member which extends down the outside surface of central body portion 21 and across flat flange portion 23. Portions 21, 22, and 24 define a fluid pouring spout passageway 32 having a pouring orifice 33 at its uppermost (outermost) end.

Figure 3:
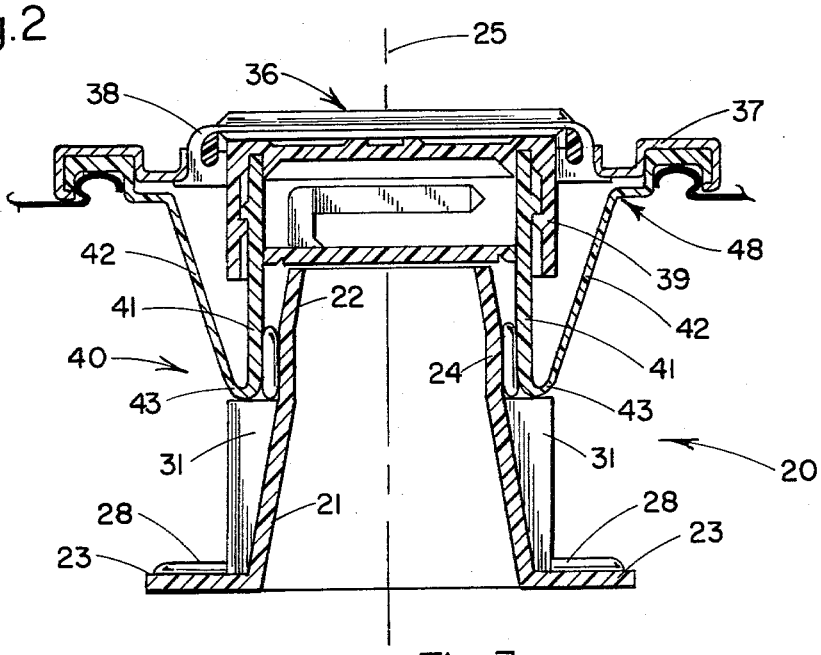
FIG. 3 is a front elevation view in full section of the FIG. 1 venting device as installed in a closure cap which is in a nested orientation.
Figure 4:
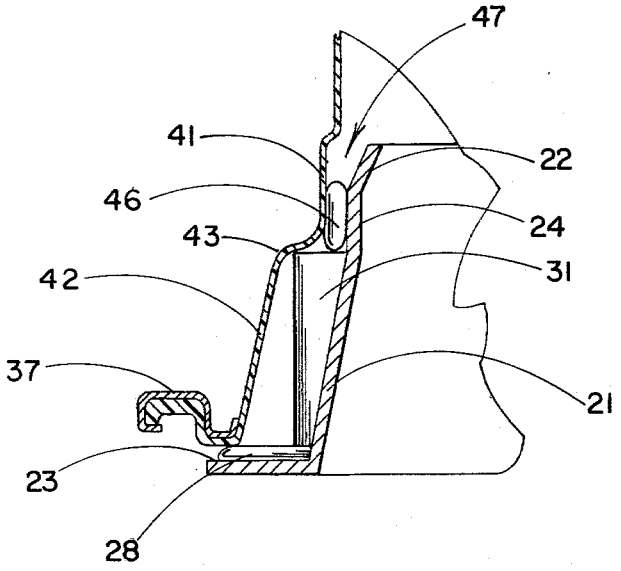
FIG. 4 is a partial front elevation view of the FIG. 3 assembly in an extended orientation including spacer tabs which provide spacing between the FIG. 1 venting device and the closure cap.
Figure 5:
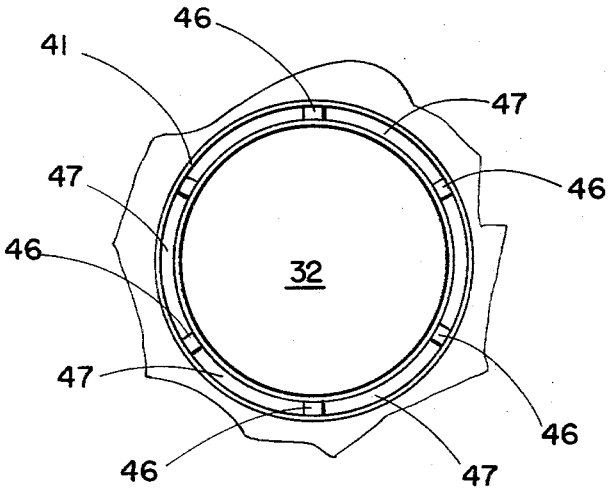
FIG. 5 is a top plan view of the FIG. 1 venting device and closure cap in an extended orientation.

Referring to FIGS. 3, 4 and 5, venting device 20 is installed in a container closure cap 36. Container closure cap 36 includes an anchor ring 37, a tamper-proof cap 38, a resealable cap 39 and a flexible pouring spout 40. Flexible pouring spout 40 is configured in a nested orientation in FIG. 3 and is configured in an extended (pouring) orientation in FIGS. 4 and 5. The design and construction of flexible pouring spouts similar to spout 40 are fully disclosed in U.S. Pat. No. 2,561,596 issued July 24, 1951 to Rieke and U.S. Pat. No. 2,565,699 issued Aug. 28, 1951 to Rieke, both of which are hereby incorporated by reference. Flexible pouring spout 40 includes an inner generally cylindrical portion 41, an outer base portion 42 and an invertible fold portion 43 at their junction. Frustoconical portion 22 extends upwardly into inner generally cylindrical portion 41 and retains this positional relationship whether the flexible pouring spout is in its nested orientation or its extended orientation.

Disposed between venting device 20 and container closure cap 36 are a plurality of spacer strips 46 and in the exemplary embodiment, there are six such strips equally spaced around the outside diameter of cylindrical portion 24 and adjacent inner portion 41 immediately above invertible fold portion 43. These six spacer strips 46 are securely joined to both inner portion 41 and cylindrical portion 24 and these spacer strips place venting device 20 in a substantially concentric relationship with flexible pouring spout 40 (see FIG. 6). Although a variety of joining means are acceptable, such as the use of adhesive, the preferred technique is to heat weld the spacer strips to portions 24 and 41.

The partial, front elevation view of FIG. 4 illustrates one such spacer strip and its relationship between cylindrical portion 24 and inner portion 41. Each spacer strip 46 is relatively thin and although joined to cylindrical portion 24, is not joined to frustoconical portion 22 due to the inwardly tapering arrangement of portion 22. These spacer strips provide a series of clearance regions 47 between venting device 20 and container closure cap 36. Due to the evenly spaced arrangement of the spacer strips, there are six such clearance regions surrounding venting device 20 (see FIG. 5).

These clearance regions permit an incoming flow of air as the fluid contents within the container are poured out. By providing a pathway for incoming venting air which does not require passage through the pouring spout or orifice from which the fluid is exiting, the exit of the liquid from within the container is accomplished in a smooth and continuous manner without disruptions or pulsations in the flow of such liquid. The design of venting device 20 is also desirable in the fact that it is arranged in a somewhat symmetrical manner and may be installed easily without regard to specific alignment or orientation with respect to container closure cap 36. A further benefit of the design as relating to the assembly procedure is that the stiffener portions 31 are substantially straight and vary in width as they extend upwardly so as to accommodate the taper of central body portion 21. Consequently, the top edge of stiffener portion 31 is substantially flat and abuts against invertible fold portion 43. This abutting engagement enables venting device 20 to be inserted at full depth into flexible pouring spout 40 and the extent of its insertion is the same each time. As an assembly aid and to add strength and support to both device 20 and spout 40, the top edge of stiffener portion 31 is joined to fold portion 43 by a heat-welding techinque which flows the material of the two component parts together.

When container closure cap 36 is extended from the nested orientation of FIG. 3 to the extended orientation of FIG. 4, substantially flat flange portion 23 is drawn upwardly into contact with edge 48 of outer base portion 42 of flexible pouring spout 40. Due to the substantially flat and flexible nature of flange portion 23 and the positional relationship between venting device 20 and container closure cap 36, if outwardly radiating ribs 28 were not present, flange portion 23 would seal up against edge 48. However, the existence of outwardly radiating ribs 28 results in a slight clearance being maintained between flange portion 23 and edge 48 such that the venting air which is entering through clearance regions 47 will be able to enter the container. Due in part to the shallow thickness of ribs 28 and the fact that flange portion 23 is snapped upwardly into engagement with edge 48 when flexible pouring spout 40 is extended, the clearance between flange portion 23 and edge 48 is very slight. This slight clearance is sufficient to allow venting air to enter but is not sufficient to allow viscous fluids to escape. Consequently, the integrity of the open air passageway through each clearance region 47 is preserved. A still further benefit from the design of venting device 20 is that the pouring spout passageway 32 has a slight inward taper and the rate of such taper is sufficient to overcome any flow loss due to fluid friction so that the orifice flows full with positive fluid pressure and thereby prevents venting air from entering the pouring orifice. This concept can be more readily understood when it is realized that with fluid friction losses, compounded by heavy viscous fluids, a pressure differential could occur which would enable air to enter the pouring orifice and thus create a pulsating fluid flow which is undesirable. By reducing the cross-sectional area of the pouring spout passageway from its base to its top end, fluid friction losses are compensated for by reduced flow cross-sectional area, thereby maintaining a positive fluid pressure.

Venting device 20 is preferably molded as a single piece homogeneous member out of a suitable flexible plastic composition such as polyethylene, or the like. This type of material as well as other thermoforming and thermosetting materials enables the parts to be molded very quickly and at low cost and provides both the flexibility required in certain areas of the part as well as structural rigidity which may be required in other areas. Although spacer strips 46 are preferably initially joined to inner portion 41, they may alternatively be first joined to cylindrical portion 24 prior to assembly.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A venting device for use with and secured to a container pour spout of the style having an outer base portion and a smaller inner cylindrical portion with an invertible fold portion therebetween, said venting device arranged to allow the entry of air into the corresponding container at a location exterior to the exiting fluid flow stream, said venting device comprising:

a hollow central body portion having a top end which includes a generally cylindrical section and joined thereto and in end-to-end relationship therewith a frustoconical section, each section extends above said invertible fold portion and into said smaller inner cylindrical portion and said top end of said hollow central body portion is arranged substantially concentric with said container pour spout in a uniformly spaced-apart manner, the resultant space between the outside surface of said top end and the inside surface of said smaller inner cylindrical portion providing a generally annular air flow passageway for entering venting air, said hollow central body portion further comprising a base and an interior passageway extending therethrough, said central body portion tapering inwardly as it extends from said base to said top end resulting in a progressively reduced cross-sectional area; and a substantially flat flange portion integral with said base and including a spaced plurality of outwardly radiating ribs.

2. An improved container closure cap of the type wherein a pour spout, arranged into an outer base portion and a smaller inner cylindrical portion is extendable to a pouring orientation from a nested orientation and vice versa, and is securely attached to an opening in the container by a retaining ring and a resealable cap is provided on the end of the pour spout for enclosing the contents of the container, wherein, the improvement comprises:

a venting device to permit entry of air into said container without affecting the exiting of fluid flow from the container, said venting device including:

a hollow central body portion having a top end, a base and an interior passageway extending therethrough, said top end extending upwardly into said smaller inner cylindrical portion;

a generally cylindrical portion integral with said top end;

a substantially flat flange portion integral with said base and including a spaced plurality of outwardly radiating ribs; and a plurality of spacer members disposed between said smaller inner cylindrical portion and said venting device, said spacer members being joined to the interior of said smaller inner cylindrical portion and the exterior of the venting device and providing a substantially annular clearance region therebetween for the entry of venting air.

3. The improvement of claim 2 wherein said central body portion tapers inwardly as it extends from said base to said top end resulting in a progressively reduced cross-sectional area.

4. The improvement of claim 3 wherein said venting device and said container closure cap are arranged substantially concentric to each other in a uniformly spaced manner by said plurality of spacer members.

5. The improvement of claim 4 which further includes a plurality of stiffener portions integrally disposed on the exterior of said central body portion.

6. The improvement of claim 5 wherein said venting device is of a single-piece, homogeneous, molded construction.

7. The improvement of claim 2 wherein said plurality of outwardly radiating ribs of said flange portion is placed in abutting engagement against said pour spout when said pour spout is extended to said pouring orientation.

8. An improved container closure cap of the type wherein a pour spout arranged into an outer base portion and a smaller inner cylindrical portion with an invertible fold portion therebetween is extendable to a pouring orientation from a nested orientation and vice versa, and is securely attached to an opening in the container by a retaining ring and a resealable cap is provided on the end of the pour spout for enclosing the contents of the container, wherein, the improvement comprises:

a venting device to permit entry of air into said container without affecting the exiting of fluid flow from the container, said venting device including:

a hollow central body portion having a top end, a base and an interior passageway extending therethrough;

a generally cylindrical portion integral with said top end;

a substantially flat flange portion integral with said base and including a spaced plurality of outwardly radiating ribs;

a plurality of spacer members disposed between said pour spout and said venting device, said spacer members being joined to the interior of the pour spout and the exterior of the venting device and providing a clearance region therebetween for the entry of venting air; and a plurality of stiffener portions integrally disposed on the exterior of said central body portion and located in abutting engagement against said invertible fold portion when said pour spout is in said nested orientation for controlling the upward insertion of said venting device into said container closure cap.

* * * * *